US008387181B1

(12) United States Patent
Hansen

(10) Patent No.: US 8,387,181 B1
(45) Date of Patent: Mar. 5, 2013

(54) SHEET SYSTEM WITH HANDLES

(76) Inventor: Susan A. Hansen, Naples, FL (US)

( * ) Notice: Subject to any disclaimer, the term of this patent is extended or adjusted under 35 U.S.C. 154(b) by 0 days.

(21) Appl. No.: 13/211,871

(22) Filed: Aug. 17, 2011

(51) Int. Cl.
*A47G 9/02* (2006.01)

(52) U.S. Cl. ..... 5/482; 5/495; 5/662

(58) Field of Classification Search ..... 5/495–497, 5/662, 929, 482
See application file for complete search history.

(56) References Cited

U.S. PATENT DOCUMENTS

| | | | | |
|---|---|---|---|---|
| D268,804 | S | 5/1983 | Bacon | |
| 4,520,518 | A | 6/1985 | Reaser | |
| 4,635,308 | A | 1/1987 | Maggio et al. | |
| 4,773,108 | A | 9/1988 | Leever | |
| 5,010,610 | A | 4/1991 | Ackley | |
| 5,020,177 | A | 6/1991 | Etherington | |
| 5,375,280 | A * | 12/1994 | O'Sullivan et al. | 5/662 |
| 6,148,458 | A * | 11/2000 | Hires | 5/485 |
| 6,874,180 | B2 * | 4/2005 | Liao | 5/486 |
| 7,316,039 | B2 * | 1/2008 | Wootten, Jr. | 5/497 |
| 7,398,569 | B2 | 7/2008 | Sakaldasis et al. | |
| 7,827,633 | B2 | 11/2010 | Taylor | |
| 2007/0174963 | A1 | 8/2007 | Howard | |
| 2010/0175195 | A1 | 7/2010 | Harris Adamson et al. | |

* cited by examiner

*Primary Examiner* — Michael Trettel

(57) ABSTRACT

A sheet system having a sheet with a top and bottom surface, a first, second, third and fourth side, the second side being opposite the first side, the sides are adapted to hug sides of a mattress, an elastic band lines a portion of bottom edges of each side, a first handle on the top surface of the sheet near the first side and near the third side, a second handle on the top surface of the sheet near the first side and about halfway between the third side and fourth side, a third handle on the top surface of the sheet near the second side and near the third side, and a fourth handle on the top surface of the sheet near the second side and about halfway between the third side and fourth side.

2 Claims, 3 Drawing Sheets

(ISO View)

(Side View)

(Bottom View)

(Cross-sectional View)

(Alternative Embodiment)

SHEET SYSTEM WITH HANDLES

FIELD OF THE INVENTION

The present invention is directed to a sheet with handles allowing a user to grip the sheet and turn him/herself in bed.

BACKGROUND OF THE INVENTION

Some individuals, for example elderly or disabled individuals, pregnant women, those with arthritis or injuries, or those individuals recovering from surgeries, find it difficult to move themselves in bed to be comfortable. The present invention features a novel sheet system with handles that allow a user to grip the sheet and turn himself/herself as needed in bed.

SUMMARY

The present invention features a sheet system with handles. In some embodiments, the sheet system comprises a sheet having a top surface, a bottom surface, a first side, a second side, a third side, and a fourth side, the second side being opposite the first side, the sides are adapted to hug sides of a mattress, an elastic band lines a portion of bottom edges of each side; a first handle disposed on the top surface of the sheet near the first side and near the third side, a second handle disposed on the top surface of the sheet near the first side and about halfway between the third side and fourth side, a third handle disposed on the top surface of the sheet near the second side and near the third side, and a fourth handle disposed on the top surface of the sheet near the second side and about halfway between the third side and fourth side.

In some embodiments, the system further comprises a fifth handle disposed on the top surface of the sheet near the third side and about halfway between the first side and the second side. In some embodiments, the system further comprises a sixth handle disposed on the top surface of the sheet about halfway between the third side and the fourth side and about halfway between the first side and the second side. In some embodiments, the handles are attached to the sheet with stitching.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Referring now to FIGS. 1-5, the present invention features a novel sheet system 100. The system 100 comprises a sheet

Figure 1:
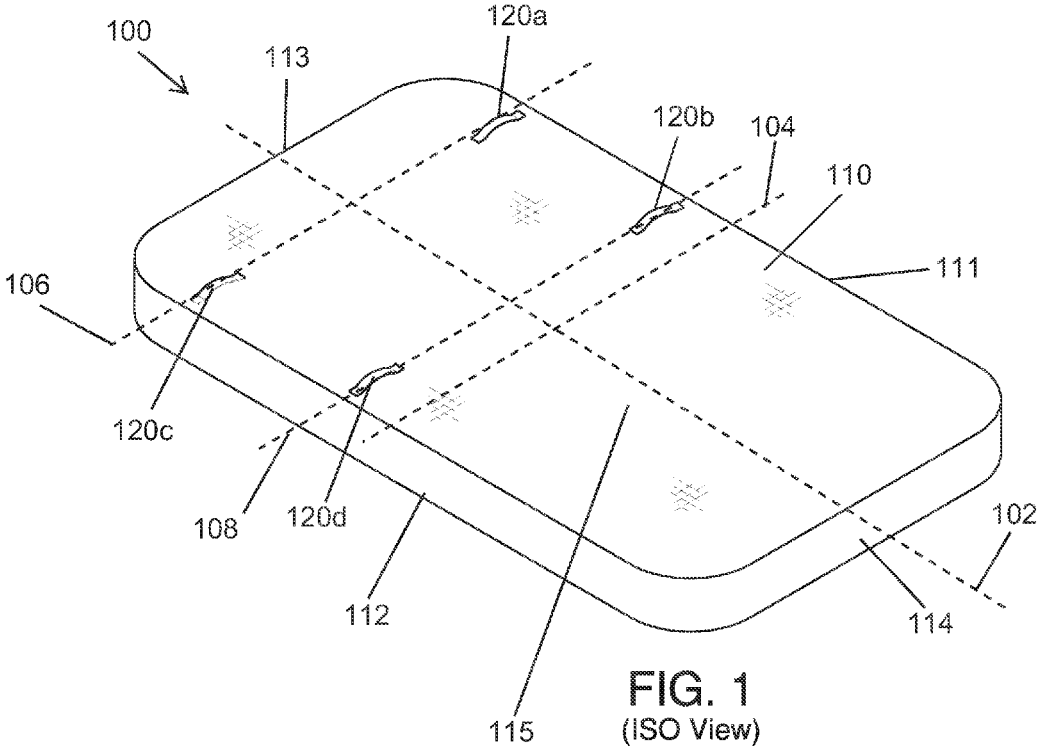
FIG. 1 is a perspective view of the system of the present invention.
Figure 2:
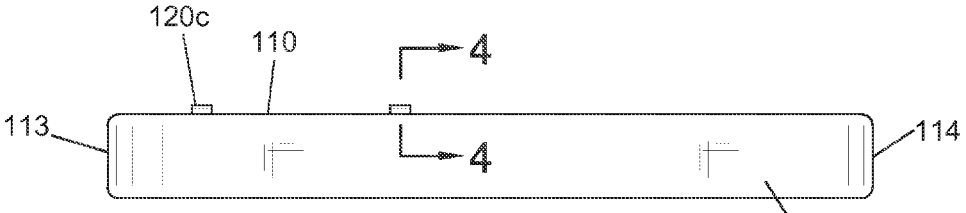
FIG. 2 is a side view of the system of the present invention.
Figure 3:
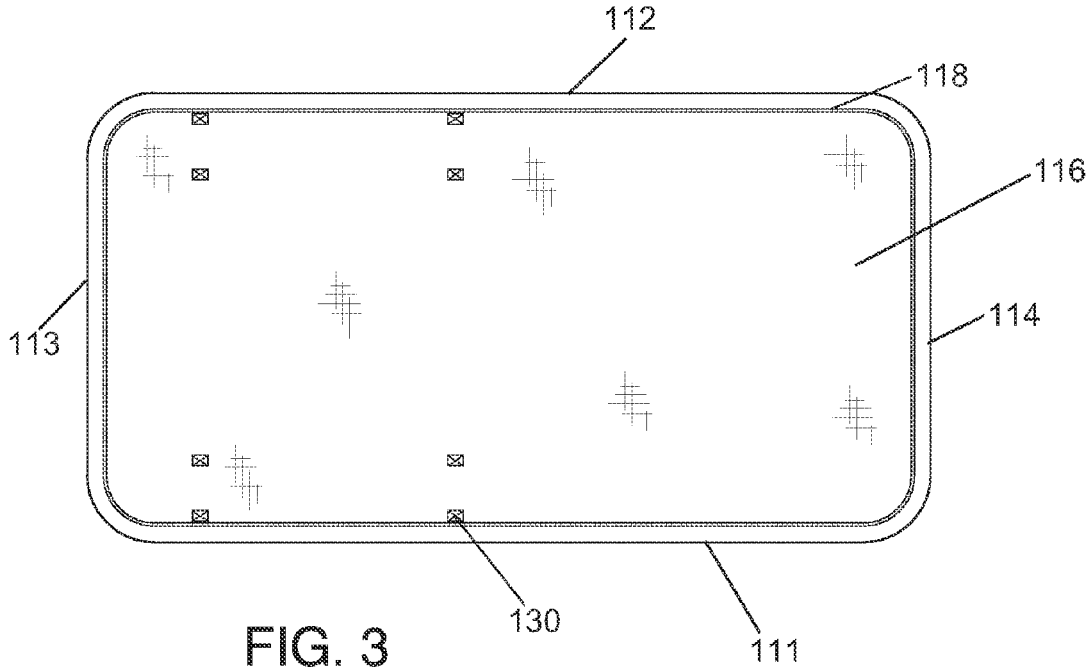
FIG. 3 is a bottom view of the system of the present invention.

110 resembling standard fitted sheets, which are well known to one of ordinary skill in the art. For example, the sheet 110 has a top surface 115, a bottom surface 116, a first side 111, a second side 112 (opposite the first side 111), a third side 113, and a fourth side 114. The sides hug the mattress. As shown in FIG. 3, an elastic band 118 is disposed on the bottom edges of each side. The elastic band helps the sheet 110 stay attached to the mattress.

Disposed on the top surface 115 of the sheet 110 is a plurality of handles 120. For example, a first handle 120*a* is disposed on the top surface 115 of the sheet 110 near the first side 111 and near the third side 113. A second handle 120*b* is disposed on the top surface 115 of the sheet near the first side 111 and about halfway between the third side 113 and fourth side 114. A third handle 120*c* is disposed on the top surface 115 of the sheet 110 near the second side 112 and near the third side 113. A fourth handle 120*d* is disposed on the top surface 115 of the sheet near the second side 112 and about halfway between the third side 113 and fourth side 114. The first handle 120*a* has the same orientation with the third handle 120*c*. The first handle 120*a* and second handle 120*b* are on one side of a first axis 102, wherein the first axis 102 divides the length of sheet in equal halves. The third handle 120*c* and fourth handle 120*d* are on opposite side of a first axis 102. All the handles 120 are one the same side of a second axis 104, wherein the second axis 104 divides the width of the sheet in equal halves.

The first handle 120*a* and second handle 120*b* are aligned on a third axis 106, wherein the third axis 106 is perpendicular to the first axis 102. The first handle 120*a* and third handle 120*c* are aligned on a fourth axis 108, wherein the fourth axis 108 is perpendicular to the first axis 102. All the handles 120 are one the same side of a second axis 104, wherein the second axis is a middle axis of the sheet 110 on the width direction.

Figure 4:
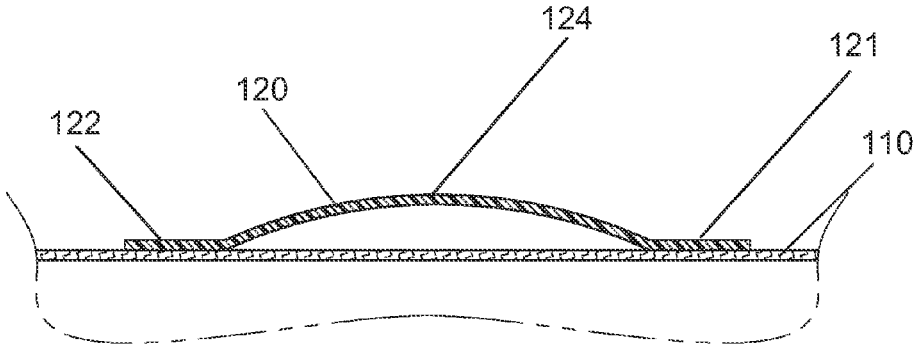
FIG. 4 is a cross sectional view of the system of the present invention.

As shown in FIG. 3, in some embodiments, the handles 120 are sewn to the sheet 110 with stitching 130. The handles 120 may be attached to the sheet in any other appropriate manner. As shown in FIG. 4, in some embodiments, the handles 120 each have a first end 121 and a second end 122, wherein the ends 121, 122 are attached to the sheet 110 and the center portions 124 of the handles 120 are unattached to the sheet 110.

Figure 5:
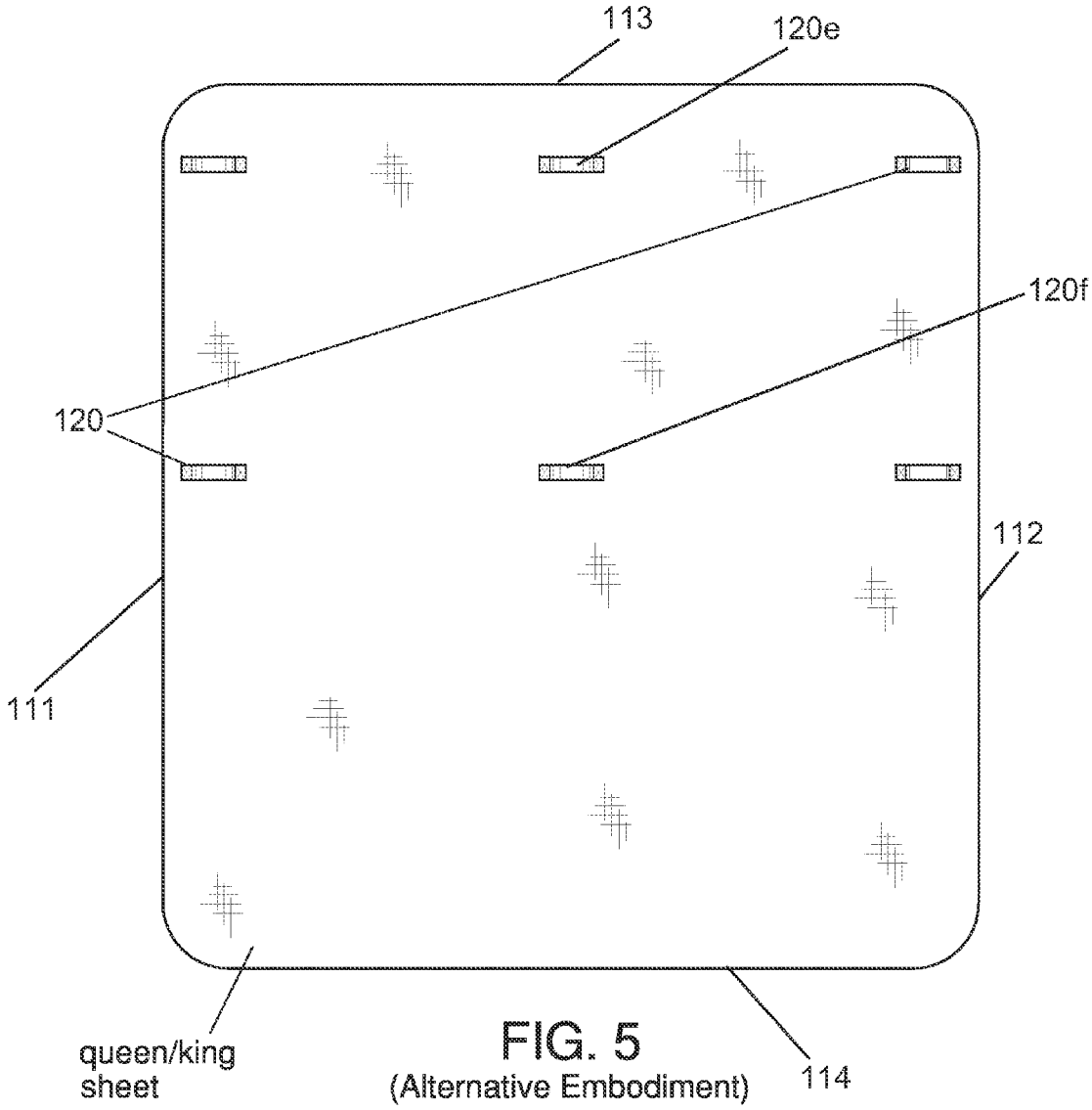
FIG. 5 is a top view of an alternative embodiment of the system of the present invention.

As shown in FIG. 5, in some embodiments, a fifth handle 120*e* is disposed on the top surface 115 of the sheet 110 near the third side 113 and about halfway between the first side 111 and the second side 112. In some embodiments, a sixth handle 120*f* is disposed on the top surface 115 of the sheet about halfway between the third side 113 and the fourth side 114 and about halfway between the first side 111 and the second side 112. All the handles have the same orientation.

The present invention may be constructed in appropriate sizes, for example for twin-sized bed, double-sized beds, queen-sized bed, king-sized beds, California king-sized beds, etc. The present invention may be constructed in a variety of styles, patterns, and designs. The present invention may be constructed from a variety of materials, for example cotton, flannel, silk, etc.

The disclosures of the following U.S. patents are incorporated in their entirety by reference herein: U.S. Design Pat. No. D268804; U.S. Pat. No. 4,520,518; U.S. Pat. No. 4,635,308; U.S. Pat. No. 4,773,108; U.S. Pat. No. 5,010,610; U.S. Pat. No. 5,020,177; U.S. Pat. No. 7,398,569; U.S. Pat. No. 7,827,633; U.S. Patent Application No. 2007/0174963; U.S. Patent Application No. 2010/0175195.

Various modifications of the invention, in addition to those described herein, will be apparent to those skilled in the art from the foregoing description. Such modifications are also intended to fail within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A sheet system (100) consisting of:

(a) a sheet (110) having a top surface (115), a bottom surface (116), a first side (111), a second side (112), a third side (113), and a fourth side (114), the second side (112) being opposite the first side (111), the sides (111), (112), (113), (114) are adapted to hug sides of a mattress, an elastic band disposed on the bottom edges of each side (111), (112), (113), (114);

(b) a first handle (120*a*) disposed on the top surface (115) of the sheet (110) near the first side (111) and near the third side (113), a second handle (120*b*) disposed on the top surface (115) of the sheet near the first side (111) and about halfway between the third side (113) and fourth side (114), a third handle (120*c*) disposed on the top surface (115) of the sheet (110) near the second side (112) and near the third side (113), and a fourth handle (120*d*) disposed on the top surface (115) of the sheet near the second side (112) and about halfway between the third side (113) and fourth side (114), wherein the handles (120) have the same orientation, wherein the first handle (120*a*) and second handle (120*b*) are on one side of a first axis (102), wherein the first axis (102) divides the length of sheet (110) into equal halves, wherein the third handle (120*c*) and fourth handle (120*d*) are on opposite side of a first axis (102), wherein all the handles (120) are one the same side of a second axis (104), wherein the second axis (104) divides the width of sheet (110) into equal halves, the first handle (120*a*) and second handle (120*b*) are aligned on a third axis (106), wherein the third axis (106) is perpendicular to the first axis (102), wherein the first handle (120*a*) and third handle (120*c*) are aligned on a fourth axis (108), wherein the fourth axis (108) is perpendicular to the first axis (102), wherein all the handles (120) are one the same side of the second axis (104); and wherein the handles (120) are attached to the sheet (110) with stitching (130).

2. A sheet system (100) consisting of:

(a) a sheet (110) having a top surface (115), a bottom surface (116), a first side (111), a second side (112), a third side (113), and a fourth side (114), the second side (112) being opposite the first side (111), the sides (111), (112), (113), (114) are adapted to hug sides of a mattress, an elastic band disposed on the bottom edges of each side (111), (112), (113), (114);

(b) a first handle (120*a*) disposed on the top surface (115) of the sheet (110) near the first side (111) and near the third side (113), a second handle (120*b*) disposed on the top surface (115) of the sheet near the first side (111) and about halfway between the third side (113) and fourth side (114), a third handle (120*c*) disposed on the top surface (115) of the sheet (110) near the second side (112) and near the third side (113), and a fourth handle (120*d*) disposed on the top surface (115) of the sheet near the second side (112) and about halfway between the third side (113) and fourth side (114), a fifth handle (120*e*) disposed on the top surface (115) of the sheet (110) near the third side (113) and about halfway between the first side (111) and the second side (112), a sixth handle (1201) disposed on the top surface (115) of the sheet about halfway between the third side (113) and the fourth side (114) and about halfway between the first side (111 and the second side (112), wherein the handles (120) have the same orientation, wherein the first handle (120*a*) and second handle (120*b*) are on one side of a first axis (102), wherein the first axis (102) divides the length of sheet (110) into equal halves, wherein the third handle (120*c*) and fourth handle (120*d*) are on opposite side of a first axis (102), wherein all the handles (120) are one the same side of a second axis (104), wherein the second axis (104) divides the width of sheet (110) into equal halves, the first handle (120*a*) and second handle (120*h*) are aligned on a third axis (106), wherein the third axis (106) is perpendicular to the first axis (102), wherein the first handle (120*a*) and third handle (120*c*) are aligned on a fourth axis (108), wherein the fourth axis (108) is perpendicular to the first axis (102), wherein all the handles (120) are one the same side of the second axis (104); and wherein the handles (120) are attached to the sheet (110) with stitching (130).

* * * * *